US010321256B2

(12) United States Patent
Dickins et al.

(10) Patent No.: US 10,321,256 B2
(45) Date of Patent: Jun. 11, 2019

(54) ADAPTIVE AUDIO CONSTRUCTION

(71) Applicant: DOLBY LABORATORIES LICENSING CORPORATION, San Francisco, CA (US)

(72) Inventors: Glenn N. Dickins, Como (AU); Richard J. Cartwright, Killara (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 25 days.

(21) Appl. No.: 15/547,043

(22) PCT Filed: Feb. 2, 2016

(86) PCT No.: PCT/US2016/016187
§ 371 (c)(1),
(2) Date: Jul. 27, 2017

(87) PCT Pub. No.: WO2016/126715
PCT Pub. Date: Aug. 11, 2016

(65) Prior Publication Data

US 2018/0014139 A1 Jan. 11, 2018

Related U.S. Application Data

(60) Provisional application No. 62/111,479, filed on Feb. 3, 2015.

(51) Int. Cl.
*H04S 7/00* (2006.01)
*H04R 5/027* (2006.01)
*H04R 3/00* (2006.01)

(52) U.S. Cl.
CPC ..... *H04S 7/303* (2013.01); *H04R 5/027* (2013.01); *H04S 7/00* (2013.01); *H04R 3/005* (2013.01);
(Continued)

(58) Field of Classification Search
CPC .. H04S 7/303; H04S 2400/11; H04S 2400/15; H04S 7/00; H04R 5/027; H04R 3/005
(Continued)

(56) References Cited

U.S. PATENT DOCUMENTS 7,606,373 B2 10/2009 Moorer
7,680,288 B2 3/2010 Melchior
(Continued)

FOREIGN PATENT DOCUMENTS

EP 2337328 6/2011
WO 2011/020067 2/2011
(Continued)

OTHER PUBLICATIONS

Lennox, P. et al "Perceptual Cartoonification in Multi-Spatial Sound Systems" The 17th International Conference on Auditory Display, Jun. 20-24, 2011, Budapest, Hungary, pp. 1-8.
(Continued)

*Primary Examiner* — Paul Kim
*Assistant Examiner* — Douglas J Suthers

(57) ABSTRACT

Systems, methods, and computer program products for creating an object-based audio signal from an audio input are described. The audio input includes one or more audio channels that are recorded to collectively define an audio scene. The one or more audio channels are captured from a respective one or more spatially separated microphones disposed in a stable spatial configuration. A system receives the audio input. The system performs spatial analysis on the one or more audio channels to identify one or more audio objects within the audio scene. The system determines contextual information relating to the one or more audio objects. The system defines respective audio streams including audio data relating to at least one of the identified one or more audio objects. The system then outputs an object-based
(Continued)

audio signal including the audio streams and the contextual information.

31 Claims, 7 Drawing Sheets

(52) U.S. Cl.
CPC ..... *H04S 2400/11* (2013.01); *H04S 2400/15* (2013.01)

(58) Field of Classification Search
USPC ..... 381/303
See application file for complete search history.

(56) References Cited

U.S. PATENT DOCUMENTS

| | | | |
|---|---|---|---|
| 8,396,576 | B2 | 3/2013 | Kraemer |
| RE44,611 | E | 11/2013 | Metcalf |
| 8,712,076 | B2 | 4/2014 | Dickins |
| 9,173,025 | B2 | 10/2015 | Dickins |
| 9,229,086 | B2 | 1/2016 | Shuang |
| 2003/0007648 | A1 | 1/2003 | Currell |
| 2006/0206221 | A1 | 9/2006 | Metcalf |
| 2010/0223552 | A1 | 9/2010 | Metcalf |
| 2011/0064249 | A1 | 3/2011 | Jang |
| 2011/0081024 | A1 | 4/2011 | Soulodre |
| 2014/0085538 | A1 | 3/2014 | Kaine |
| 2014/0112480 | A1 | 4/2014 | Audfray |
| 2014/0133683 | A1 | 5/2014 | Robinson |
| 2014/0211969 | A1 | 7/2014 | Kim |

FOREIGN PATENT DOCUMENTS

| | | |
|---|---|---|
| WO | 2013/090463 | 6/2013 |
| WO | 2014/204997 | 12/2014 |

OTHER PUBLICATIONS

Myatt, A. et al "From Surround to True 3-D" AES 16th International Conference on Spatial Sound Reproduction, pp. 1-10, 1999.

Van Trees, Harry L., "Optimum Array Processing: Part IV of Detection, Estimation and Modulation Theory" John Wiley, May 2002.

ADAPTIVE AUDIO CONSTRUCTION

CROSS REFERENCE TO RELATED APPLICATIONS

This application claims priority to U.S. Provisional Patent Application No. 62/111,479, filed on Feb. 3, 2015, which is hereby incorporated by reference in its entirety.

TECHNOLOGY

The present Application relates to audio signal processing. More specifically, embodiments of the present invention relate to processing of input audio signals to generate an adaptive audio output.

While some embodiments will be described herein with particular reference to that application, it will be appreciated that the invention is not limited to such a field of use, and is applicable in broader contexts.

BACKGROUND

Any discussion of the background art throughout the specification should in no way be considered as an admission that such art is widely known or forms part of common general knowledge in the field.

In artistic or developed multi-media content, the audio component is rarely just a capture or accurate representation of the sound that was or would have been present at the camera or video point of view. Generally, in creating media, various forms of post-processing are performed on the captured audio signals to enhance and/or modify them.

For conventional audio associated with multimedia productions, there are two main accepted approaches for creating a final produced audio mix. Generally, the audio is created and output in a predetermined format, which most often includes a set of audio channels for a specific speaker layout, or a set of channels with an additional coding structure that allows a decoder to subsequently decode the channels for a specific speaker layout. These two approaches are shown schematically in FIGS. 1 and 2.

The approach illustrated in FIG. 1 involves the use of captured and stored audio elements (stems) and a manual mixing and mastering process to create a theatrical or produced mix. The approach illustrated in FIG. 2 involves the use of an array of microphones or a spatial microphone with some optional format conversion or mapping to create a realistic impression of the original sound field in the final multichannel output.

There is a desire for the development of a more flexible format and representation of multichannel or spatial audio which allows for more flexibility and possibility at the point of output or rendering.

SUMMARY OF EXAMPLE EMBODIMENTS

In accordance with a first aspect of the present invention there is provided a method for creating an object-based audio signal from an audio input, the audio input including one or more audio channels that are recorded to collectively define an audio scene, the one or more audio channels being captured from a respective one or more spatially separated microphones disposed in a stable spatial configuration, the method including the steps of:

a) receiving the audio input;
b) performing spatial analysis on the one or more audio channels to identify one or more audio objects within the audio scene;
c) determining contextual information relating to the one or more audio objects;
d) defining respective audio streams including audio data relating to at least one of the identified one or more audio objects; and
e) outputting an object-based audio signal including the audio streams and the contextual information.

In one embodiment the method includes the further step of:

a) i) receiving external context information relevant to the audio input.

In one embodiment the spatial analysis is performed based on the external context information.

In one embodiment the method includes the further step of:

d) i) selectively manipulating one or more of the audio streams to modify spatial properties of the associated audio objects.

In some embodiments the selective manipulation is performed based at least in part on the contextual information. In some embodiments the selective manipulating is performed based at least in part on the external context information.

In one embodiment the external context information includes additional audio or video data relevant to the audio scene. In one embodiment the external context information includes control input from a user. In one embodiment the external context information includes one or more context mode settings relating to a theme of the audio scene.

In one embodiment the contextual information includes an object type. In one embodiment the contextual information includes spatial properties of an audio object. The spatial properties preferably includes one or more of the size, shape, position, coherence, direction of travel, velocity or acceleration of an audio object relative to the spatial configuration.

The audio objects preferably include one or more of voice, ambient sounds, instruments and noise.

In one embodiment the step of selectively manipulating one or more of the audio streams includes removing predetermined sounds based on their spatial, temporal or frequency characteristics. In one embodiment the step of selectively manipulating one or more of the audio streams includes modifying a panning an audio object within the audio scene. In one embodiment the step of selectively manipulating one or more of the audio streams includes modifying a perceived direction of travel of an audio object within the audio scene. In one embodiment the step of selectively manipulating one or more of the audio streams includes modifying a background and/or foreground audio scene component. In one embodiment the step of selectively manipulating one or more of the audio streams includes assigning to an audio object a spatial trajectory through the audio scene. In one embodiment the step of selectively manipulating one or more of the audio streams includes modifying a perceived velocity of an audio object through the audio scene.

In one embodiment the step of defining respective audio streams includes performing a beamforming technique on the one or more audio channels. In one embodiment the step of defining respective audio streams includes suppressing specific audio components.

In one embodiment performing spatial audio analysis includes performing one or more of beamforming audio event detection, level estimation, spatial clustering, spatial classification and temporal data analysis.

In one embodiment the method includes the steps:

f) receiving the object-based audio signal;

g) performing effects processing on one or more of the audio streams; and h) outputting a modified object-based audio signal.

In one embodiment the step of performing effects processing is automated without user input. In one embodiment the step of performing effects processing is based at least in part on external context information relevant to the audio input.

The effects processing preferably includes, for a given audio stream, performing one or more of equalization, Doppler frequency shifting, tremolo, vibrato, chorus, distortion, harmonization, vocoder analysis, autotuning, delaying, applying or adjusting echo and applying or adjusting reverb.

In one embodiment the modified object-based audio signal has a different number of audio streams than the object-based audio signal.

In one embodiment the one or more audio signals are directly input from the array of microphones.

In one embodiment the object-based audio signal is an encoded signal. The encoded signal is preferably encoded using an encoding method determined based on the type of audio objects detected in the audio input.

In accordance with a second aspect of the present invention there is provided a computer-based system including a processor configured to perform the method according to the first aspect.

In one embodiment the computer-based system includes a user interface to facilitate the selection of particular audio streams. In one embodiment the user interface is further adapted to facilitate the provision of external context information. In one embodiment the user interface is further adapted to facilitate the application of particular audio effects.

In accordance with a third aspect of the present invention there is provided a system for creating an object-based audio signal from an audio input, the audio input including one or more audio channels that are recorded to collectively define an audio scene, the one or more audio channels being captured from a respective one or more spatially separated microphones disposed in a stable spatial configuration, the method including the steps of:

an input port for receiving the audio input;

a processor configured to:

perform spatial analysis on the one or more audio channels to identify one or more audio objects within the audio scene;

determine contextual information relating to the one or more audio objects; and define respective audio streams including audio data relating to at least one of the identified one or more audio objects; and an output port for outputting an object-based audio signal including the audio streams and the contextual information.

In one embodiment the system according to the third aspect includes a user interface to facilitate the selection of particular audio streams.

BRIEF DESCRIPTION OF THE DRAWINGS

Preferred embodiments of the disclosure will now be described, by way of example only, with reference to the accompanying drawings in which.

DESCRIPTION OF EXAMPLE EMBODIMENTS

Overview

Figure 1:
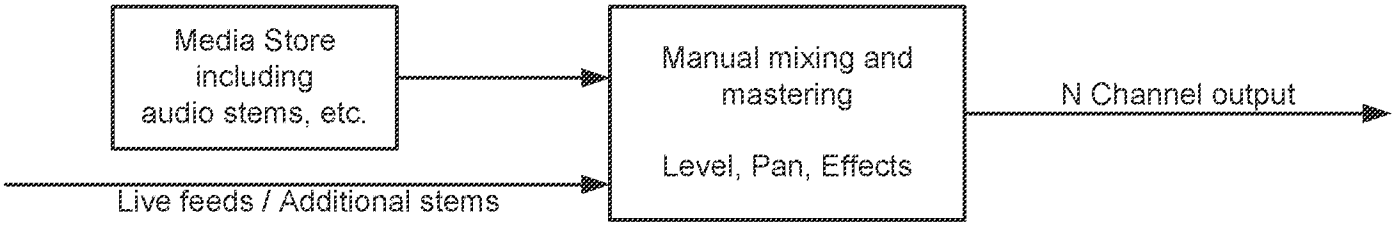
Figure 1 (Prior Art)
FIG. 1 is a schematic process-level diagram of a first approach of conventional production and processing to create audio in a fixed multichannel format using captured and stored audio elements (stems) and a manual mixing and mastering process.
Figure 2:
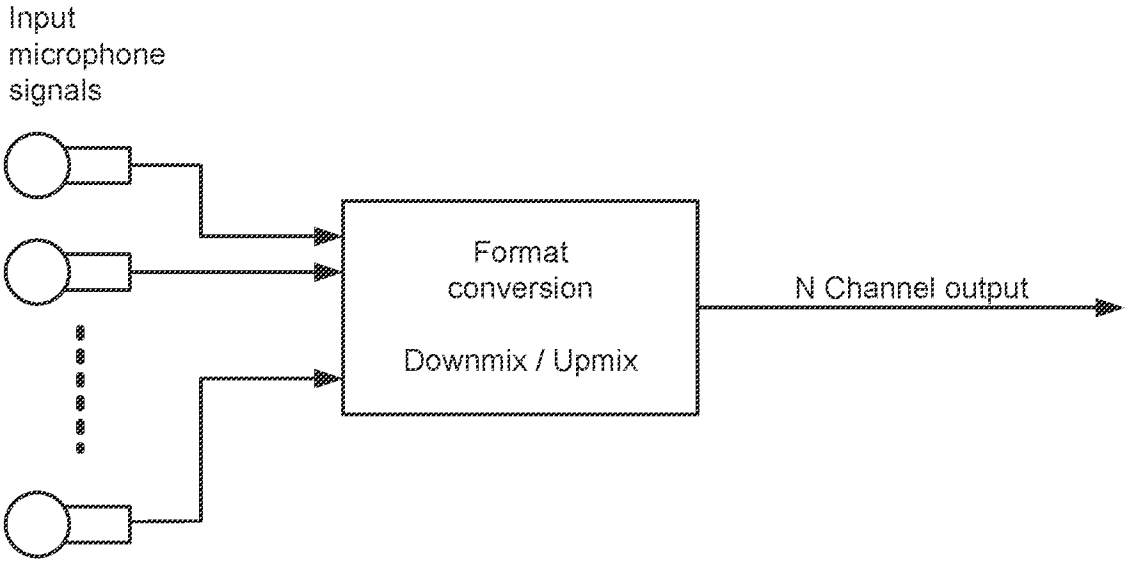
Figure 2 (Prior Art)
FIG. 2 is a schematic process-level diagram of a second approach of conventional production and processing to create audio in a fixed multichannel format using a set of microphones with optional format conversion.
Figure 3:
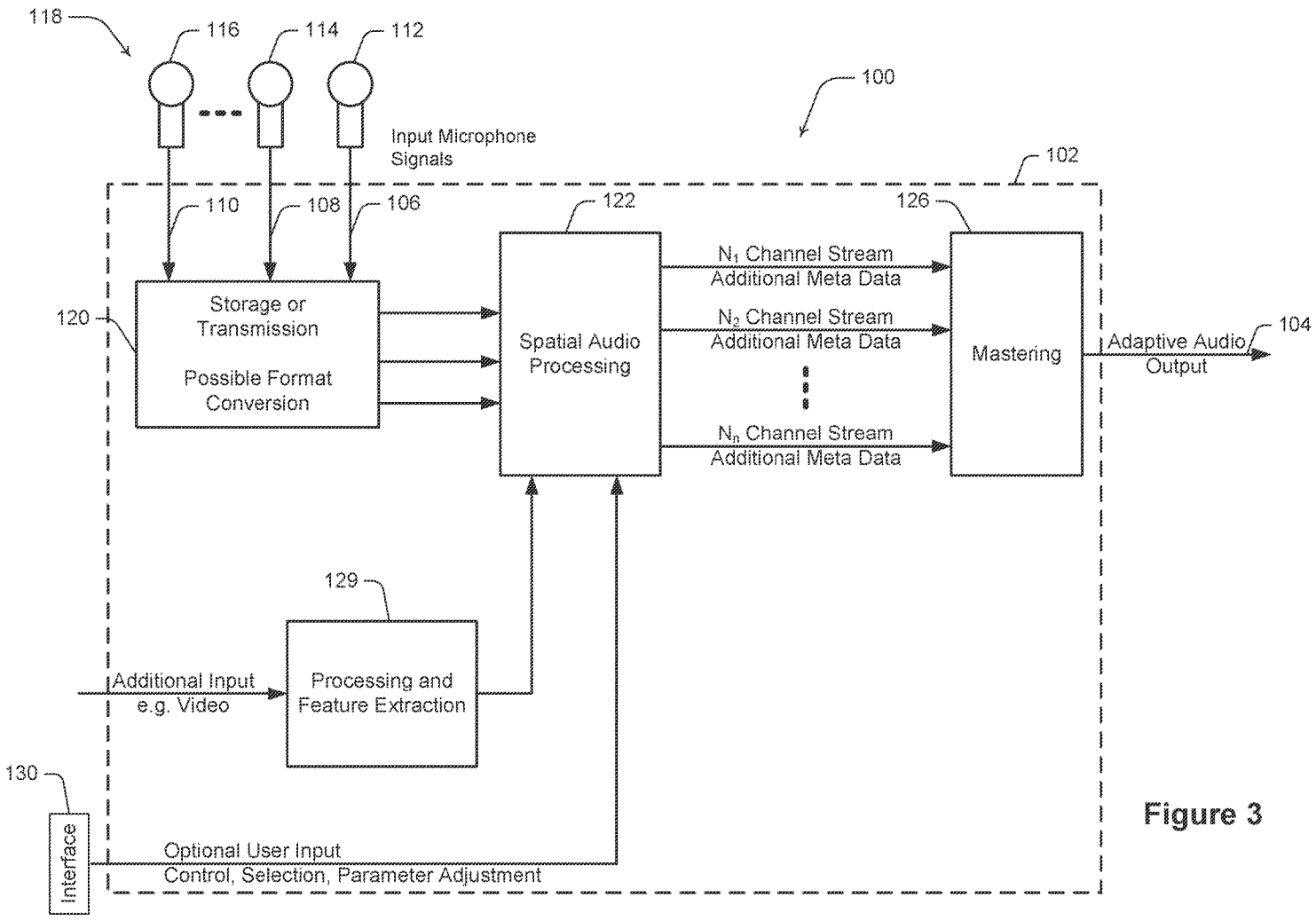
FIG. 3 is a schematic process-level diagram of a system for creating an object-based adaptive audio signal from an audio input captured from a spatial array of microphones.
Figure 4:
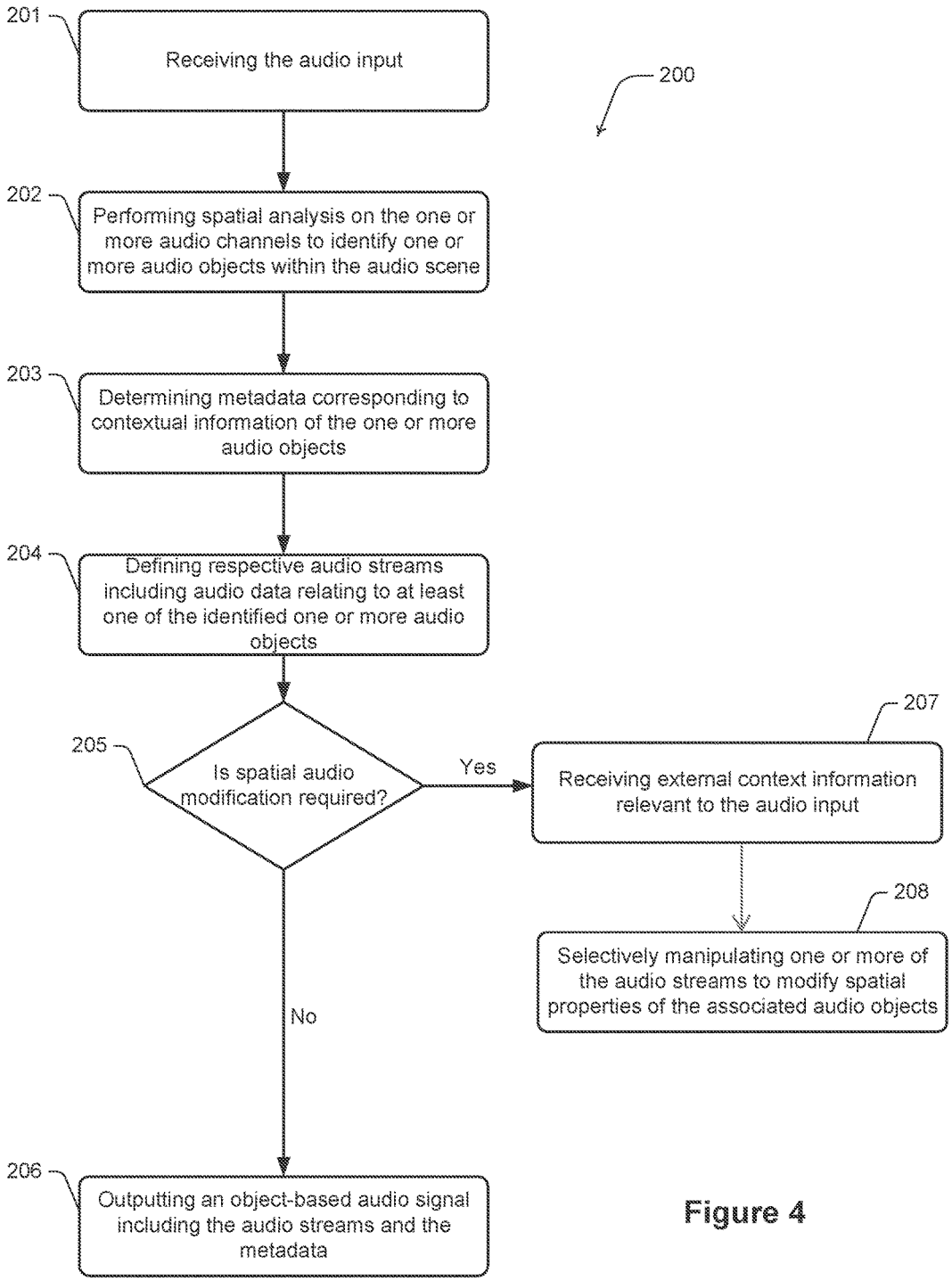
FIG. 4 is a process flow diagram illustrating the primary steps in a method for creating an object-based adaptive audio signal from an audio input captured from a spatial array of microphones.

Referring to FIGS. 3 and 4 there is illustrated a computer-based system 100 including a processor 102 configured to perform a method 200 for creating an object-based adaptive audio signal 104 from an audio input including three exemplary audio channels 106, 108, 110 that collectively define an audio scene. Each audio channel is captured from a respective spatially separated microphone 112, 114 and 116 disposed in a stable spatial configuration 118. Although three microphones are illustrated, it will be appreciated that an arbitrary number and configuration of microphones are able to be implemented in the present invention.

Initially, at step 201, the audio input, in the form of channels 106, 108 and 110, are input to processor 102. The channels are initially processed by a pre-processing module 120 to perform format conversion, buffering, storage if necessary and other signal processing operations. In other embodiments, this pre-processing is performed externally by a separate processor before input to the computer-based system. In the case of digital microphones, the audio channels represent digital signals. In the case of analog microphones, the audio channels represent analog signals. In this latter case, module 120 is configured to convert the analog audio channels to equivalent digital signals.

For the purposes of clarity, module 120 and other modules described below are described in the context of functional blocks performed by processor 102 (or equivalent parallel processors) in the form of software algorithms. However, it will be appreciated that an equivalent method can be performed in a digital or analog sense by separate hardware modules programmed with appropriate logic.

Although not illustrated, in some embodiments, pre-processing module 120 multiplexes channels 106, 108 and 110 into a single digital audio signal for further processing.

Figure 5:
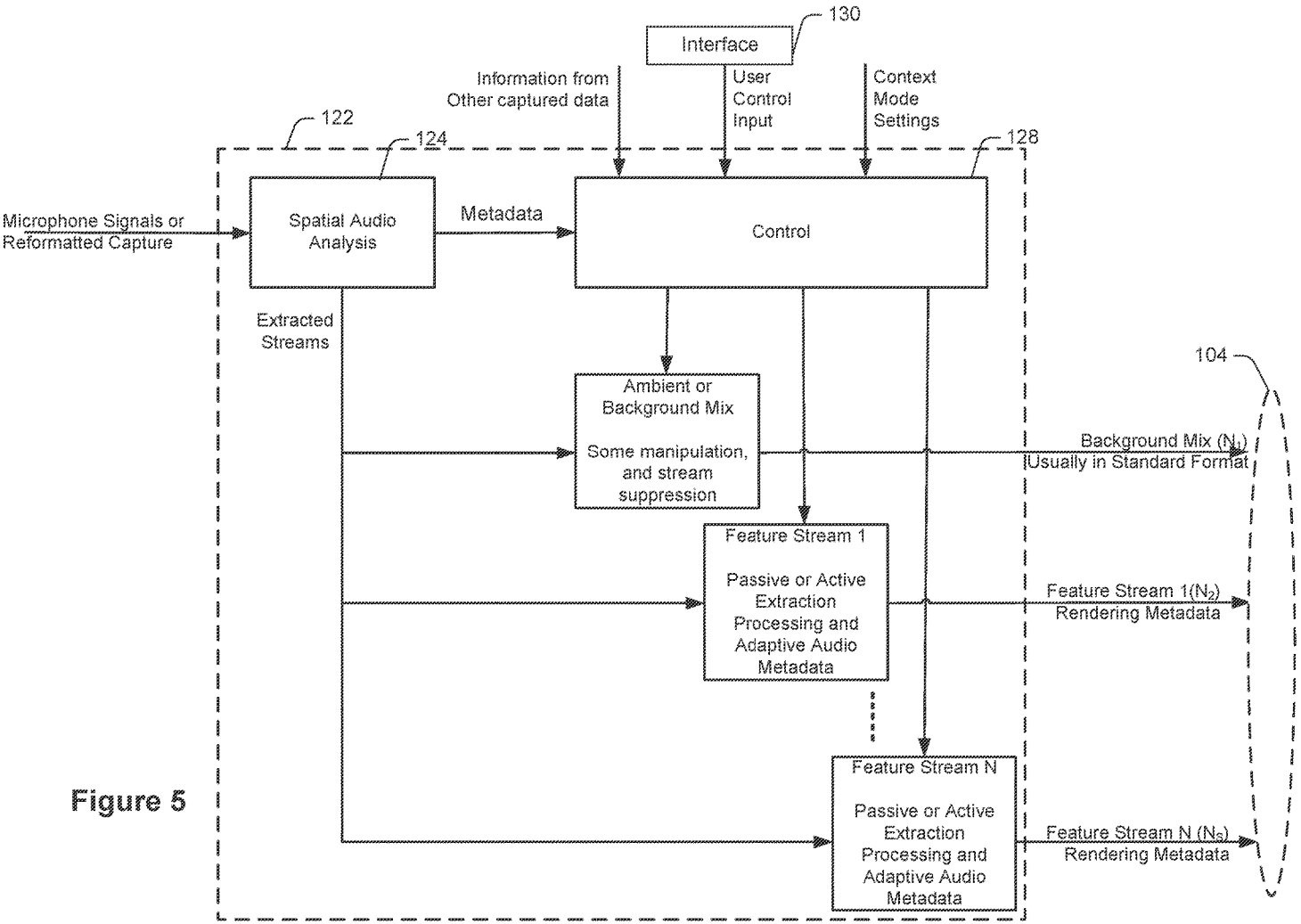
FIG. 5 is a schematic process-level diagram of the spatial audio processing module of FIG. 3.

The audio channels are input into a spatial audio processing module 122. Referring now to FIG. 5, the function of module 122 is expanded schematically. At step 202, a spatial audio analysis module 124 performs spatial analysis on the audio channels to identify different audio objects within the recorded audio scene. Audio objects represent particular components of the captured audio input that are spatially or otherwise distinct and include audio such as voices, instruments, music, ambience, background noise and other sound effects such as approaching cars.

The spatial analysis procedure includes performing a number of possible subroutines which are adapted to identify different audio objects within an audio input based on spatial properties. These subroutines necessarily require spatial information about the different microphones used to record the audio, including their relative position and direction. With this information, module 124 is able to identify the audio objects based on particular spatial properties of the objects. Exemplary subroutines for performing this object identification process include beamforming, audio event detection, level estimation, spatial clustering, spatial classification and temporal data analysis.

Examples of the spatial properties determined include:

- Object size and shape. The perceived size and shape of the object within the audio scene. For example, a person speaking may be determined to be a small or point source being partially directional in the direction the person is facing.
- Object position within the audio scene. The position can be established in one, two or three dimensions.
- Coherence of the object audio.
- Direction of travel of the object through the audio scene.
- Velocity or acceleration of the object through the audio scene.
- Classification of the object based on audio features associated with the activity of that object (for example, voice versus noise versus nuisance audio).
- History or aggregated statistics of the past values of the above parameters and estimations around the scene such as the duty cycle of activity, statistics of the length of activity, average spectra or level information, etc.

All of these spatial properties allow for the accurate identification of different audio objects within the audio input. In some embodiments, this spatial data is supplemented or augmented with additional data to better identify the objects. These additional data include frequency, pitch, amplitude, tone detection voice recognition and timing of the audio components. These supplementary identification procedures help where, for example, a person moves to a new location within the audio scene between verbal dialog.

By way of example, module 124 identifies a first person speaking for a first period of time at a stationary position of 30 degrees within the audio scene and a second person speaking for a second period of time at a stationary position of 45 degrees within the audio scene. During both the first and second periods of time, an ambient car sound shifts across the audio scene at an escalating level. Module 124 is able to identify the first person, second person and car as three separate audio objects based on their spatial properties.

At step 203, as part of the spatial analysis and object identification process, module 124 determines metadata corresponding to contextual information of the one or more audio objects. Generally, this contextual information includes an object type such as speech, music or ambience, an object name or identifier (for example, "second speaker" or "guitar sounds"), an analysis of the overall scene, specific speakers to output the audio object and various types of spatial object information as indicated above.

At step 204, module 124 defines and outputs respective audio streams, each of which include audio data relating to at least one of the identified audio objects. Preferably, each stream contains audio data relating primarily to a single audio object with some optional overlap of other objects. As will be described below, imperfect isolation of audio objects is typically satisfactory and often desirable in this process. Typically a first audio stream would represent background audio objects and subsequent audio streams would represent specific items such as individual voices or instruments.

By way of example, to extract audio of a person speaking at a position of 30 degrees within the audio scene, module 124 defines an audio stream as audio data received from that position during a period in which the person is identified to have been speaking. As speech generally has directional properties, audio from particular channels from microphones located in front of the person may be more dominant over other channels from microphones located behind the person. If the person is identified to have been walking through the audio scene while talking, module 124 is adapted to capture audio data that follows the trajectory of the person through the audio scene during their speech.

At this point, decision 205 is made as to whether spatial audio modification of the audio streams is required at this stage. This decision is made automatically or through specific user input. If no spatial modification of the audio streams is required, the procedure progresses to step 206 wherein an object-based audio signal 104 is output. This object-based audio signal 104 includes the audio streams corresponding to different audio objects and the associated metadata containing information about the audio objects. In the illustrated embodiment, the audio streams and metadata are separately output to a mastering module 126, as shown in FIG. 3. Module 126 is adapted to provide automatic mastering or allow user input to provide manual mastering. In another embodiment, the audio streams and metadata are multiplexed into a single signal prior to input to mastering module 126.

Module 126 performs mastering of the object-based audio signal into a desired output format having a predetermined encoding. In one embodiment, the encoded signal is encoded using an encoding method that is determined based on the type of audio objects detected in the audio input. For example, an object-based audio signal having predominantly speech objects may be encoded differently to an object-based audio signal having more music or instrumental based objects.

The object-based audio signal is flexible in the sense that the additional metadata can be used to identify objects and control the positioning and rendering of each audio object in the final output by modifying or adapting the specific audio streams. As such, this flexible audio format is also referred to by the inventors as an 'adaptive audio' format, as illustrated in FIG. 3.

The output object-based adaptive audio signal 104 is suitable for rendering on a multi-channel playback audio system having a spatial speaker setup such as Dolby® 5.1 or Dolby® 7.1 surround sound setups. In particular, Dolby Atmos® audio systems are configured to render audio on an object basis using object metadata.

Referring again to FIG. 4, if spatial modification of the audio streams is required, the procedure progresses to step 207 wherein a control module 128 is fed external context information relevant to the audio input. In response to the external context information, module 128 performs step 208 of selectively manipulating one or more of the audio streams to modify spatial properties of the associated audio objects. In some embodiments, the selective manipulation is also performed at least in part on the metadata. In one embodiment, the spatial analysis step is also performed based on this external context information by feeding the external context information to spatial audio analysis module 124.

The external context information provided to module 128 includes additional audio or video data relevant to the audio scene such as the associated video captures for that scene (such as a movie scene). Such additional data is optionally processed by a processing module 129 and audio or video features may be pre-extracted or isolated. Examples of additional audio include pre-recorded audio stems or sound effects. The external context information also includes one or more context mode settings for the audio scene which are realized as audio presets. These settings specify a theme of the audio scene such as an ambient scene, concert mode or a dialog scene.

To facilitate the spatial audio modification, the external context information also includes control input from a user provided by way of a computer interface 130. Interface 130 includes control software rendered on a computer display (not shown) and controlled by user input through hardware such as a keyboard, mouse and/or touchscreen. The control input includes the selection of streams to manipulate and select a type of modification or effects to apply to the selected streams. Interface 130 also allows a user to input one or more audio strategies for the overall scene such as a suppression strategy or leveling strategy. In one embodiment, the control software renders a visual representation of the audio scene showing the locations of the microphones and allowing spatial manipulation of the objects within the scene.

The actual spatial manipulation of the streams includes a number of possible processes including panning, relocating, reshaping or rotating the objects within the audio scene, modifying an object's velocity through the audio scene or modifying a perceived direction of travel of an audio object within the audio scene. Additional forms of audio manipulation are able to be performed on the streams. Examples of these different audio manipulation effects are included in Table 1 below.

TABLE 1

| Effect | Description | Input from Spatial Audio Analysis Module | User or Additional Input |
|---|---|---|---|
| Remove | Remove certain sounds based on their spatial, temporal or frequency characteristics. | Scene analysis Cluster map Instantaneous signal | Suppression strategy |
| Enhance Distance | Enhance the sense of distance or change in distance-attenuate, amplify, equalize, reverb. | Scene analysis Instantaneous signal | Stream selection Desired effect and level |
| Modify Direction | Modify the directional characteristics of particular elements or background sounds (E.g. rotate, pinch, move, remap) | Scene analysis Instantaneous | Stream selection Desired effect, level and direction |
| Modify Level | Selectively modify the level of audio scene components (E.g increase foreground to background level) | Scene analysis Instantaneous signal | Levelling Strategy Stream selection Direction selection |
| Extraction | Extract a stream as a separate adaptive audio stream and assign trajectories/ properties | Scene analysis Instantaneous signal | Stream selection Trajectory generation strategy |

The appropriately encoded and formatted adaptive audio output signal is able to be passed to other devices for further mixing, mastering and rendering by additional users such as audio engineers and sound producers. With appropriate software loaded onto those other devices, the other users are able to load the metadata and identify which streams belong to which audio objects. This allows for simple object-based manipulation of the audio signal.

Figure 6:
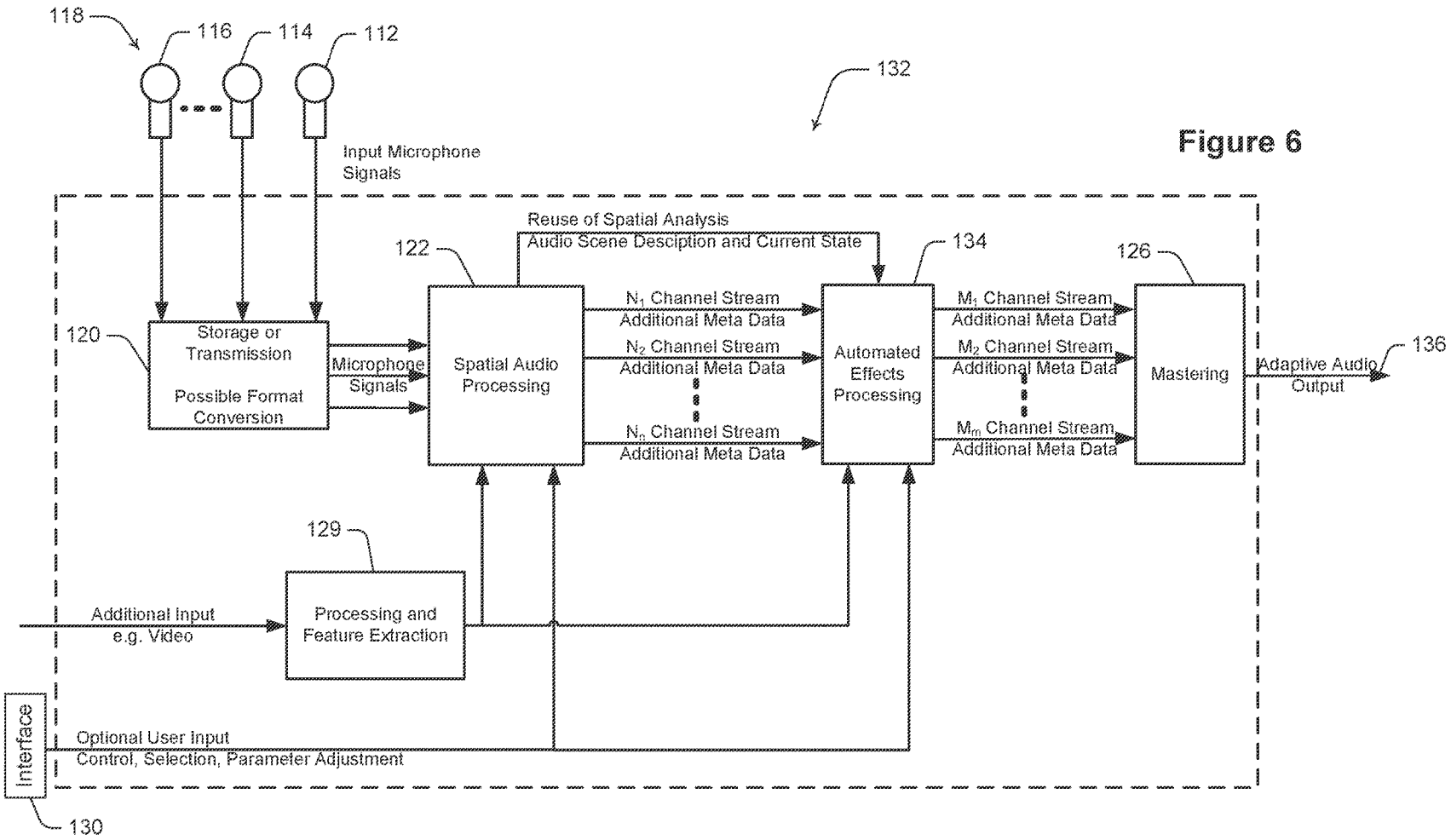
FIG. 6 is a schematic process-level diagram of a system for creating and modifying an object-based adaptive audio signal from an audio input captured from a spatial array of microphones.
Figure 7:
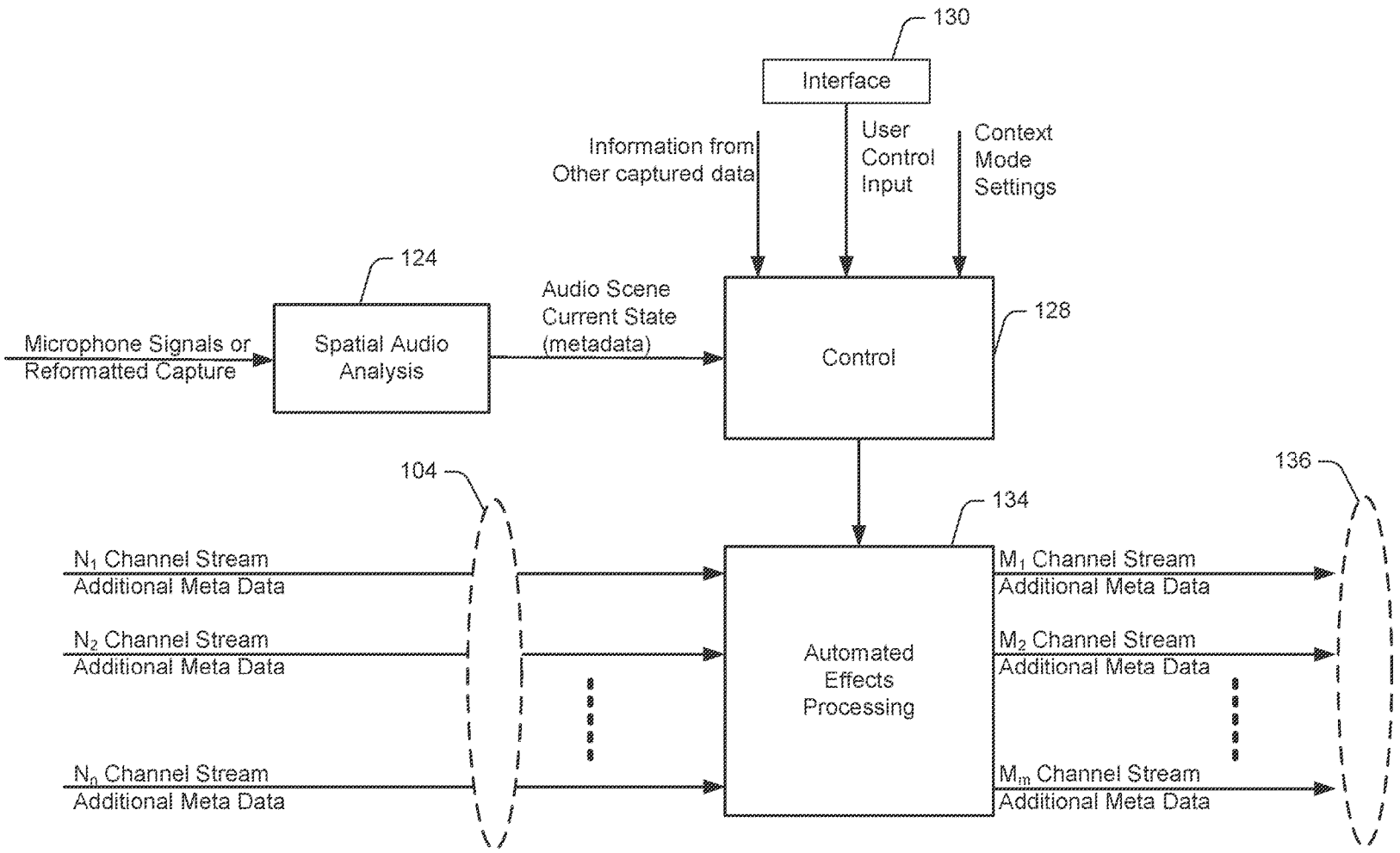
FIG. 7 is a schematic process-level diagram of the automated effects processing performed by the system illustrated in FIG. 6.

Referring now to FIG. 6, there is illustrated a second embodiment of the invention in the form of a system 132 for creating and modifying an object-based adaptive audio signal. In system 132, the object based audio signal (or signals corresponding to each audio stream) is further processed by an automated effects processing module 134. Module 134 is configured to receive the object-based audio signal, perform effects processing on one or more of the audio streams and output a modified object-based audio signal in the form of an adaptive audio signal 136. To perform this effects processing, module 134 leverages the spatial analysis previously performed by module 124 in step 202 described above and the external context information. In particular, module 134 is able to leverage a past or current scene analysis performed by module 124 and use this information as a basis for further effects processing. For example a current estimate of an active audio object, such as an object direction and likely object type can be based on measured historical contextual information from the scene analysis. Although module 134 is adapted to perform this process automatically, user input is able to be provided for tailored effects processing.

The effects processing includes, for a given audio stream, performing one or more of equalization, Doppler frequency shifting, tremolo, vibrato, chorus, distortion, harmonization, vocoder analysis, autotuning, delaying, applying or adjusting echo and applying or adjusting reverb. The specific amount and type of effects performed depends upon the metadata output from the spatial audio analysis and the external context information. For example, an audio stream corresponding to a voice within a dialog based audio scene may be processed differently to a stream corresponding to a particular instrument within an orchestral audio scene.

Examples of effects that can be performed on the audio streams are set out in Table 2 below.

TABLE 2

| Effect | Description | Spatial Control | Additional Input Control |
|---|---|---|---|
| Equalization | Specific EQ to a particular scene element to achieve an additional effect of distance, elevation or other transmission effects such as a time varying EQ for fading. | Scene element identifier | Object (stream) selection<br>Strength |
| Doppler | Frequency shift simulating a Doppler shift for a moving object. | Scene element identifier<br>Angle and trajectory | Object (stream) selection<br>Strength, Rate |
| Tremelo, Vibrato, Chorus, Distortion | Standard audio effects. | Scene element identifier<br>Movement of object<br>Loudness | Object (stream) selection<br>Strength, Rate |
| Hamonizer, Vocoder, Autotune | Voice or musical effects. | Scene element identifier<br>Movement of object<br>Loudness | Object (stream) selection<br>Strength, Shifts, Patch |
| Delay | The addition of delay or advance for artistic effect. | Scene element identifier<br>Movement of object | Delay control |
| Echo, Reverb | Specific echo pattern or detailed reverberation (e.g. gated, reverse) | Scene element identifier<br>Movement, Loudness | Object (stream) selection<br>Reverb specification |

In performing the effects processing, one or more audio streams may be created or consolidated. That is, an input object-based audio signal having N audio streams may be produce an adaptive audio signal with M audio streams, with M being greater than, equal to or less than N.

Due to the spatial audio analysis previously carried out, the effects processing has spatial awareness of the objects. Thus, the system allows for the application of audio effects on an object or spatial basis.

The above described system and method need not necessarily achieve a perfect extraction and isolation of a particular audio object from the audio scene captured. That is, particular audio streams may capture data from unintended audio objects. Rather, the design of the processing, manipulation, extraction and modification can be relaxed to focus towards a measure of perceptual outcome. This is different and somewhat contrary to conventional audio mixing where audio is discretely and directly separated by frequency into sub-bands and interference between audio of two objects is considered to be crosstalk or noise. Hence, by modifying or enhancing one audio object, other audio objects may also be somewhat modified. This perceptual modification of the audio input has the effect of 'cartoonifying' the audio signal.

Using the present invention, it is possible to achieve a much wider palette of artistic scene creation from captured audio than available in the un processed audio mix, and thus create a wider possibility for the authored adaptive audio content.

Conclusions

It will be appreciated that the above described invention provides significant systems and methods for creating an object-based adaptive audio signal from an audio input. The adaptive audio signal includes streams separated on an object basis, which contrasts from the conventional channel based audio.

The invention provides a system and method for producing an object based adaptive audio output from a received live or stored multi-channel microphone audio mix. This involves the analysis, processing and formatting of the multi-microphone audio input to take greater advantage of the discrete stream and flexible rendering capabilities of the adaptive audio format in use. Rather than the use of a manual mixing process, the present invention allows for automatically generating possible adaptive audio mixes from the multi-microphone input audio and other associated cross model, context, user specified or metadata input.

The present invention also allows the easy modification of the spatial properties of captured audio in a way that is suited to audio representation in an object based 'adaptive audio' format to enhance the playback and viewer experience. For example, the invention allows modifying a captured soundfield by exaggerating, shifting and/or biasing certain spatial properties.

The invention involves the combination of existing and new analysis and signal processing components in a way that facilitates modification and augmentation of an audio scene captured by multiple microphones to create an adaptive audio signal for use in intelligent rendering and playback audio systems.

Interpretation

Unless specifically stated otherwise, as apparent from the following discussions, it is appreciated that throughout the specification discussions utilizing terms such as "processing," "computing," "calculating," "determining", analyzing" or the like, refer to the action and/or processes of a computer or computing system, or similar electronic computing device, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. The processing system further may be a distributed processing system with processors coupled by a network. If the processing system requires a display, such a display may be included, e.g., a liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term memory unit as used herein, if clear from the context and unless explicitly stated otherwise, also encompasses a storage system such as a disk drive unit. The processing system in some configurations may include a sound output device, and a network interface device. The memory subsystem thus includes a computer-readable carrier medium that carries computer-readable code (e.g., software) including a set of instructions to cause performing, when executed by one or more processors, one of more of the methods described herein. Note that when the method includes several elements, e.g., several steps, no ordering of such elements is implied, unless specifically stated. The software may reside in the hard disk, or may also reside, completely or at least partially, within the RAM and/or within the processor during execution thereof by the computer system. Thus, the memory and the processor also constitute computer-readable carrier medium carrying computer-readable code.

Furthermore, a computer-readable carrier medium may form, or be included in a computer program product.

In alternative embodiments, the one or more processors operate as a standalone device or may be connected, e.g., networked to other processor(s), in a networked deployment, the one or more processors may operate in the capacity of a server or a user machine in server-user network environment, or as a peer machine in a peer-to-peer or distributed network environment. The one or more processors may form a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Note that while diagrams only show a single processor and a single memory that carries the computer-readable code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, one embodiment of each of the methods described herein is in the form of a computer-readable carrier medium carrying a set of instructions, e.g., a computer program that is for execution on one or more processors, e.g., one or more processors that are part of web server arrangement. Thus, as will be appreciated by those skilled in the art, embodiments of the present invention may be embodied as a method, an apparatus such as a special purpose apparatus, an apparatus such as a data processing system, or a computer-readable carrier medium, e.g., a computer program product. The computer-readable carrier medium carries computer readable code including a set of instructions that when executed on one or more processors cause the processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code embodied in the medium.

The software may further be transmitted or received over a network via a network interface device. While the carrier medium is shown in an example embodiment to be a single medium, the term "carrier medium" should be taken to include a single medium or multiple media (e.g., a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media. Non-volatile media includes, for example, optical, magnetic disks, and magneto-optical disks. Volatile media includes dynamic memory, such as main memory. Transmission media includes coaxial cables, copper wire and fiber optics, including the wires that comprise a bus subsystem. Transmission media also may also take the form of acoustic or light waves, such as those generated during radio wave and infrared data communications. For example, the term "carrier medium" shall accordingly be taken to include, but not be limited to, solid-state memories, a computer product embodied in optical and magnetic media; a medium bearing a propagated signal detectable by at least one processor or one or more processors and representing a set of instructions that, when executed, implement a method; and a transmission medium in a network bearing a propagated signal detectable by at least one processor of the one or more processors and representing the set of instructions.

It will be understood that the steps of methods discussed are performed in one embodiment by an appropriate processor (or processors) of a processing (e.g., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

Reference throughout this specification to "one embodiment", "some embodiments" or "an embodiment" means that a particular feature, structure or characteristic described in connection with the embodiment is included in at least one embodiment of the present disclosure. Thus, appearances of the phrases "in one embodiment", "in some embodiments" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

It should be appreciated that in the above description of example embodiments of the disclosure, various features of the disclosure are sometimes grouped together in a single embodiment, Fig., or description thereof for the purpose of streamlining the disclosure and aiding in the understanding of one or more of the various inventive aspects. This method of disclosure, however, is not to be interpreted as reflecting an intention that the claims require more features than are expressly recited in each claim. Rather, as the following claims reflect, inventive aspects lie in less than all features of a single foregoing disclosed embodiment. Thus, the claims following the Description are hereby expressly incorporated into this Description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those skilled in the art. For example, in the following claims, any of the claimed embodiments can be used in any combination.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical, electrical or optical contact, or that two or more elements are not in direct contact with each other but yet still co-operate or interact with each other.

Thus, while there has been described what are believed to be the best modes of the invention, those skilled in the art will recognize that other and further modifications may be made thereto without departing from the spirit of the disclosure, and it is intended to claim all such changes and modifications as fall within the scope of the disclosure. For example, any formulas given above are merely representative of procedures that may be used. Functionality may be added or deleted from the block diagrams and operations may be interchanged among functional blocks. Steps may be added or deleted to methods described within the scope of the present disclosure.

We claim:

1. A method for creating an object-based audio signal from an audio input, the audio input including one or more audio channels that are recorded to collectively define an audio scene, the one or more audio channels being captured from a respective one or more spatially separated microphones disposed in a stable spatial configuration, the method including the steps of:

a) receiving, by a spatial audio analysis module, the audio input;

b) performing spatial analysis on the one or more audio channels to identify one or more audio objects within the audio scene;

c) determining contextual information relating to the one or more audio objects, wherein the contextual information includes spatial properties of the one or more audio objects;

d) defining respective audio streams including audio data relating to at least one of the identified one or more audio objects;

e) outputting, by the spatial audio analysis module, an object-based audio signal including the audio streams and the contextual information;

f) receiving, by an automated effects processing module, the object-based audio signal;

g) performing effects processing on one or more of the audio streams to generate a modified object-based audio signal, wherein the effects processing is based on the contextual information and on external context information that is external to the audio signal, and wherein the effects processing includes performing Doppler frequency shifting for a given audio stream based on the spatial properties included in the contextual information; and h) outputting, by the automated effects processing module, the modified object-based audio signal as an encoded signal.

2. A method according to claim 1 including the further step of:

receiving, by the spatial audio analysis module, the external context information, the external context information being relevant to the audio input.

3. A method according to claim 2 wherein the spatial analysis is performed based on the external context information.

4. A method according to claim 2 including the further step of:

selectively manipulating one or more of the audio streams to modify spatial properties of associated audio objects of the one or more audio streams.

5. A method according to claim 4 wherein the selectively manipulating is performed based at least in part on the contextual information.

6. A method according to claim 4 wherein the selectively manipulating is performed based at least in part on the external context information.

7. A method according to claim 4 in their dependence on claim 4 wherein the step of selectively manipulating one or more of the audio streams includes removing predetermined sounds based on their spatial, temporal or frequency characteristics.

8. A method according to claim 4 wherein the step of selectively manipulating one or more of the audio streams includes modifying a panning an audio object within the audio scene.

9. A method according to claim 4 wherein the step of selectively manipulating one or more of the audio streams includes modifying a perceived direction of travel of an audio object within the audio scene.

10. A method according to claim 4 wherein the step of selectively manipulating one or more of the audio streams includes modifying a background and/or foreground audio scene component.

11. A method according to claim 4 wherein the step of selectively manipulating one or more of the audio streams includes assigning to an audio object a spatial trajectory through the audio scene.

12. A method according to claim 4 wherein the step of selectively manipulating one or more of the audio streams includes modifying a perceived velocity of an audio object through the audio scene.

13. A method according to claim 2 wherein the external context information includes additional audio or video data relevant to the audio scene.

14. A method according to claim 2 wherein the external context information includes control input from a user.

15. A method according to claim 2 wherein the external context information includes one or more context mode settings relating to a theme of the audio scene.

16. A method according to claim 1 wherein the contextual information includes an object type.

17. A method according to claim 1 wherein the spatial properties includes one or more of size, shape, position, coherence, direction of travel, velocity or acceleration of an audio object relative to the spatial configuration.

18. A method according to claim 1 wherein the audio objects include one or more of voice, ambient sounds, instruments and noise.

19. A method according to claim 1 wherein the audio input includes a plurality of audio channels, and wherein the step of defining respective audio streams includes performing a beamforming technique on the plurality of audio channels.

20. A method according to claim 1 wherein the step of defining respective audio streams includes suppressing specific audio components.

21. A method according to claim 1 wherein the audio input includes a plurality of audio channels, and wherein performing spatial audio analysis includes performing one or more of beamforming, audio event detection, level estimation, spatial clustering, spatial classification and temporal data analysis.

22. A method according to claim 1 wherein the step of performing effects processing is automated without user input.

23. A method according to claim 1 wherein the effects processing further includes, for a given audio stream, performing one or more of equalization, tremolo, vibrato, chorus, distortion, harmonization, vocoder analysis, autotuning, delaying, applying or adjusting echo and applying or adjusting reverb.

24. The method according to claim 1 wherein the modified object-based audio signal has a different number of audio streams than the object-based audio signal.

25. A method according to claim 1 wherein the one or more audio channels are directly input from an array of microphones.

26. A method according to claim 1 wherein the encoded signal is encoded using an encoding method determined based on a type of audio objects detected in the audio input.

27. A computer-based system including a processor configured to perform the method according to claim 1.

28. The computer-based system according to claim 27 including a user interface to facilitate selection of particular audio streams.

29. The computer-based system according to claim 28 wherein the user interface is further adapted to facilitate application of particular audio effects.

30. A system for creating an object-based audio signal from an audio input, the audio input including one or more audio channels that are recorded to collectively define an audio scene, the one or more audio channels having been captured from a respective one or more spatially separated microphones disposed in a stable spatial configuration, the system including:

an input port for receiving the audio input; and a processor configured to:

perform spatial analysis on the one or more audio channels to identify one or more audio objects within the audio scene;

determine contextual information relating to the one or more audio objects, wherein the contextual information includes spatial properties of the one or more audio objects; and define respective audio streams including audio data relating to at least one of the identified one or more audio objects;

wherein the processor is further configured to:

perform effects processing on the one or more audio streams to generate a modified object-based audio signal, wherein the effects processing is based on the contextual information and on external context information that is external to the audio signal, and wherein the effects processing includes performing Doppler frequency shifting for a given audio stream based on the spatial properties included in the contextual information; and wherein the system further comprises a mastering module for mastering and outputting the modified object-based audio signal as an encoded signal, the modified object-based audio signal including the audio streams and the contextual information.

31. A system according to claim 30 including a user interface to facilitate selection of particular audio streams.

* * * * *